US005513606A

United States Patent [19]

Shibata

[11] Patent Number: 5,513,606

[45] Date of Patent: May 7, 1996

[54] MARINE PROPULSION UNIT

[75] Inventor: Yasuhiko Shibata, Hamamatsu, Japan

[73] Assignee: Sanshin Kogyo Kabushiki Kaisha, Hamamatsu, Japan

[21] Appl. No.: 228,207

[22] Filed: Apr. 15, 1994

[30] Foreign Application Priority Data

Apr. 15, 1993 [JP] Japan ..... 5-112246

[51] Int. Cl.[6] ..... F02F 1/42

[52] U.S. Cl. ..... 123/184.34; 123/184.42; 123/195 HC

[58] Field of Search ..... 123/184.23, 184.24, 123/184.31, 184.32, 184.33, 184.34, 184.36, 184.35, 184.37, 184.38, 184.39, 184.42, 184.86, 184.47, 184.53, 184.57, 193.5, 193.3, 195 HC

[56] References Cited

U.S. PATENT DOCUMENTS

| | | | |
|---|---|---|---|
| 4,257,368 | 3/1981 | Hofbauer | 123/184.31 |
| 4,520,627 | 6/1985 | Reichenbach et al. | 123/193.5 |
| 4,760,703 | 8/1988 | Minami et al. | 123/184.42 |
| 4,817,566 | 4/1989 | Newman | 123/184.33 |
| 4,879,980 | 11/1989 | Piazzo | 123/193.5 |
| 5,050,701 | 9/1991 | Okui et al. | 123/184.42 |
| 5,129,367 | 7/1992 | Lee et al. | 123/184.42 |

*Primary Examiner*—Marguerite Macy
*Attorney, Agent, or Firm*—Knobbe, Martens, Olson & Bear

[57] ABSTRACT

Several embodiments of internal combustion engines for use in outboard motors that permits a compact construction. This is achieved by having the intake ports of the cylinder head have a U-shaped configuration and positioning the induction system on the side of the engine with the charge former extending into a recess formed by the cylinder block above the crankcase. Intake pipes extend along the side of the crankcase and are served by a plenum chamber that is spaced from the crankcase. Both V and in-line engines are disclosed.

36 Claims, 5 Drawing Sheets

MARINE PROPULSION UNIT

BACKGROUND OF THE INVENTION

This invention relates to an internal combustion engine and particularly to an improved induction system for an internal combustion engine that facilitates its use as the power plant of an outboard motor or other marine propulsion unit.

It is well known that internal combustion engines are used as a power source in many applications. Also, in many of these applications it is desirable to maintain the engine and its auxiliaries such as the induction system quite compact in nature. One particular application for internal combustion engines where this is true is in outboard motors. In an outboard motor, the engine forms a portion of the power head and is contained within a protection cowling. It is desirable to maintain the power head relatively compact and this gives rise to a number of problems in the design of the engine and its auxiliaries.

These problems are particularly true when the powering internal combustion engine is of the four-cycle type and includes an overhead valve mechanism. With such engines, the induction system which provides at least an air charge to the combustion chambers generally extends transversely outwardly from one side of the cylinder head. This has a tendency to make the engine very bulky and requires a large protective cowling.

In order to avoid these problems, it would be possible to have the induction system extend from the cylinder head down along one side of the cylinder block to maintain a more compact nature. Normally the induction system for outboard motors includes a plenum chamber that serves the function of tuning the intake passages for good engine induction efficiency and also for silencing the intake air. Therefore, it is generally desirable to maintain a relatively large volume for the plenum chamber. However, when the plenum chamber extends along the side of the cylinder block, then enlargement of its volume presents problems and can again cause the engine to become bulky in a transverse direction and require large protection cowlings. Also, this positioning for the plenum chamber somewhat shortens the length of the intake passages that extend from the plenum chamber to the cylinder head intake port and makes tuning of the induction system, particularly for good mid-range performance, very difficult.

It is, therefore, a principle object of this invention to provide an improved internal combustion engine and induction system therefor.

It is a further object of this invention to provide an improved and compact induction system for an internal combustion engine that facilitates its use in an outboard motor and which permits tuning of the induction system.

From the foregoing description it should be apparent that it is desirable to position the induction system for an engine along one side of the cylinder block, particularly when utilized in conjunction with an outboard motor. However, this positioning with conventional cylinder head intake porting requires an intake manifold that snakes around the cylinder head and back toward the cylinder block. Such intake manifolds are difficult to fabricate, add to the expense of the engine and also make the engine more bulky.

It is, therefore, a still further object of this invention to provide an improved cylinder head intake passage arrangement.

It is a further object of this invention to provide an improved cylinder head intake passage arrangement for an engine that facilitates its use with outboard motors.

SUMMARY OF THE INVENTION

A first feature of this invention is adapted to be embodied in an internal combustion engine that is comprised of a cylinder block which defines at least one cylinder bore. A cylinder head is affixed to the cylinder block at one end thereof and encloses one end of the cylinder bore. The cylinder head has an intake port on one side thereof which serves the cylinder bore. A crankcase chamber is formed at the other end of the cylinder block and contains a crankshaft journalled for rotation about an axis at the other end of the cylinder bore and driven by a piston reciprocating in the cylinder bore. The cylinder block has a portion on the side thereof adjacent the intake port which is juxtaposed to the cylinder bore and terminates at a second portion that extends laterally outwardly beyond the first portion and which defines in part the crankcase chamber for clearing the rotation of the crankshaft. A charge forming device serves the intake port and is juxtaposed to the first portion of the cylinder block. An air intake pipe extends from the charge forming device along at least a portion of the second engine portion. A plenum chamber communicates with the intake pipe and is positioned at least in part beyond the crankcase chamber on the side opposite the cylinder head.

Another feature of the invention is also adapted to be embodied in an internal combustion engine that is comprised of a cylinder block defining at least one cylinder bore. A cylinder head is affixed to the cylinder block at one end thereof and has a surface which faces the cylinder block and which closes one end of the cylinder bore. The cylinder head has a portion that extends laterally outwardly beyond the cylinder block. An intake port has an inlet opening in the extending portion of the cylinder head and which extends through the cylinder head and terminates at the cylinder bore for supplying a charge to the cylinder bore.

Either of the aforenoted features are particularly adapted for use as a power plant in an outboard motor wherein the crankshaft rotates about a vertically extending axis and the engine including its induction system is surrounded by a protective cowling.

DETAILED DESCRIPTION OF THE PREFERRED EMBODIMENTS OF THE INVENTION

Figure 1:
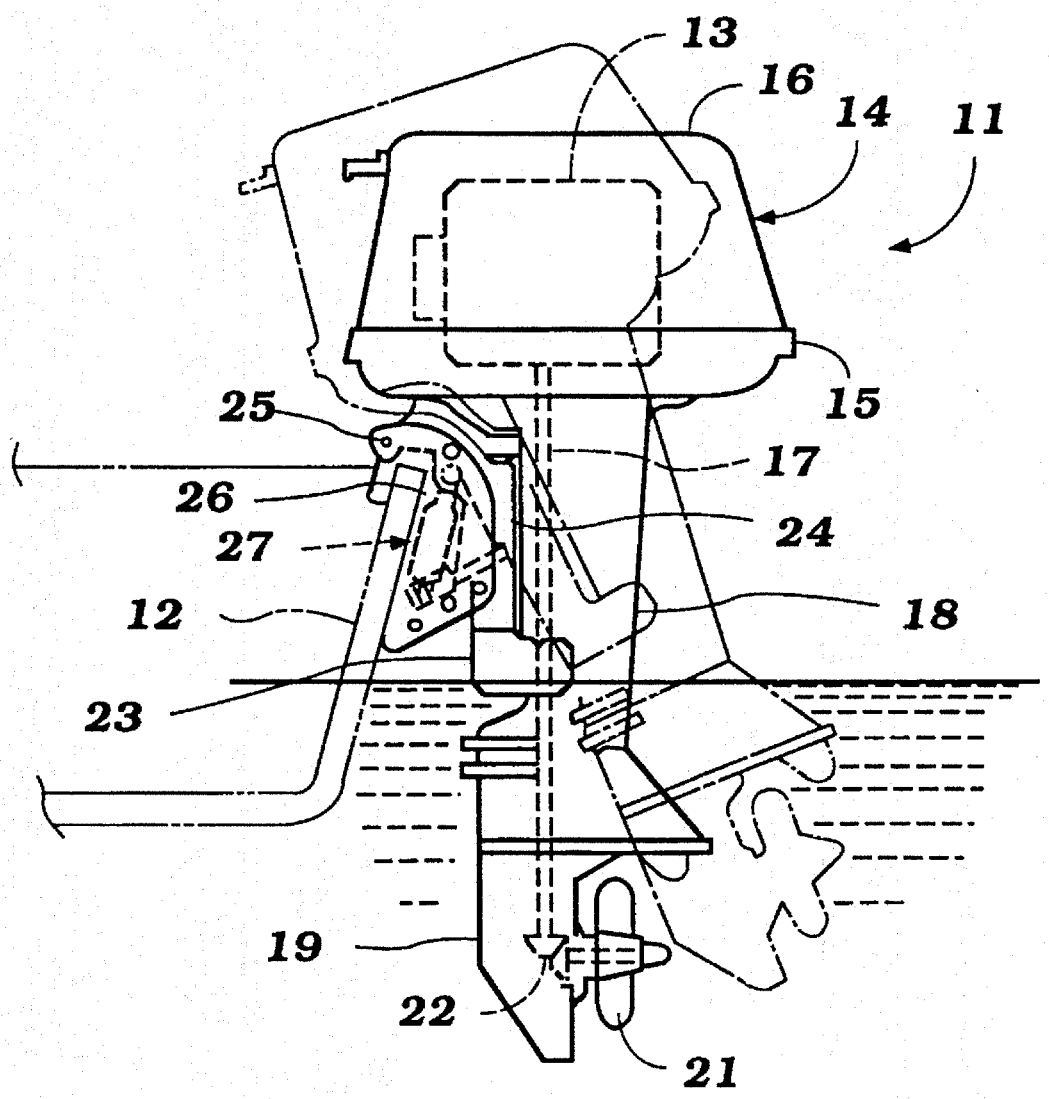
FIG. 1 is a side elevational view of an outboard motor powered by an internal combustion engine and constructed in accordance with an embodiment of the invention shown as attached to the transom of a watercraft, illustrated partially and in phantom. The solid line view shows the outboard motor in its fully trimmed down condition while the phantom line view shows it in a trimmed up condition.

Referring now in detail to the drawings and initially to FIG. 1, an outboard motor constructed in accordance with an embodiment of the invention is indicated generally by the reference numeral 11 and is shown as attached to the transom of an associated watercraft, indicated at 12 and shown only partially and in phantom. The invention is described in conjunction with an outboard motor because it has particular utility in such applications. However and as will become readily apparent to those skilled in the art, the invention may be employed in conjunction with other applications for internal combustion engines. The invention has particular utility, however, in conjunction with applications for engines wherein compact configuration of the engine package is required.

The outboard motor 11 is comprised of a power head that consists of an internal combustion engine, shown in block form in FIG. 1 and indicated generally by the reference numeral 13. This engine 13 is enclosed by a protective cowling, indicated generally by the reference numeral 14 and comprised of a lower tray portion 15 which may be formed from a lightweight metal or alloy such as aluminum and a main cowling portion 16, normally formed from a plastic such as a molded fiberglass reinforced plastic that is detachably connected to the tray 15 in a known manner. The construction of the engine 13 will be described in more detail later by reference to the remaining figures.

As is typical with outboard motor practice, the engine 13 is supported so that its output shaft rotates about a vertically extending axis. The engine output shaft is connected in a suitable manner to a drive shaft 17 which is journalled for rotation within a drive shaft housing 18 in a well known manner. The lower end of the drive shaft 17 depends into a lower unit 19 formed at the lower end of the drive shaft housing 18 and drives a propeller 21 through a suitable transmission 22.

A steering shaft, not shown, is affixed to the drive shaft housing 18 by means including a lower bracket 23. This steering shaft is supported for steering movement about a vertically extending axis within a swivel bracket 24. The swivel bracket 24 is connected by means of a pivot pin 25 to a clamping bracket 26. The clamping bracket 26 is affixed in a suitable manner to the watercraft transom 12. The pivot pin 25 permits the outboard motor 11 to be trimmed and tilted up about the horizontally disposed axis formed by the pivot pin 25.

A hydraulic shock absorber and/or power tilt and trim unit 27 of any known type is interposed between the clamping bracket 26 and the swivel bracket 24 for permitting the outboard motor 11 to pop up when an underwater obstacle is struck, to return to its position once the underwater obstacle is cleared, to resist popping up when operating in a reverse mode if the transmission 22 includes a reverse drive section and for power adjustment, if desired.

The construction of the outboard motor 11 as thus far described may be considered to be conventional, and for that reason, further details of the construction of the outboard motor are not believed to be necessary to enable those skilled in the art to practice the invention.

Figure 2:
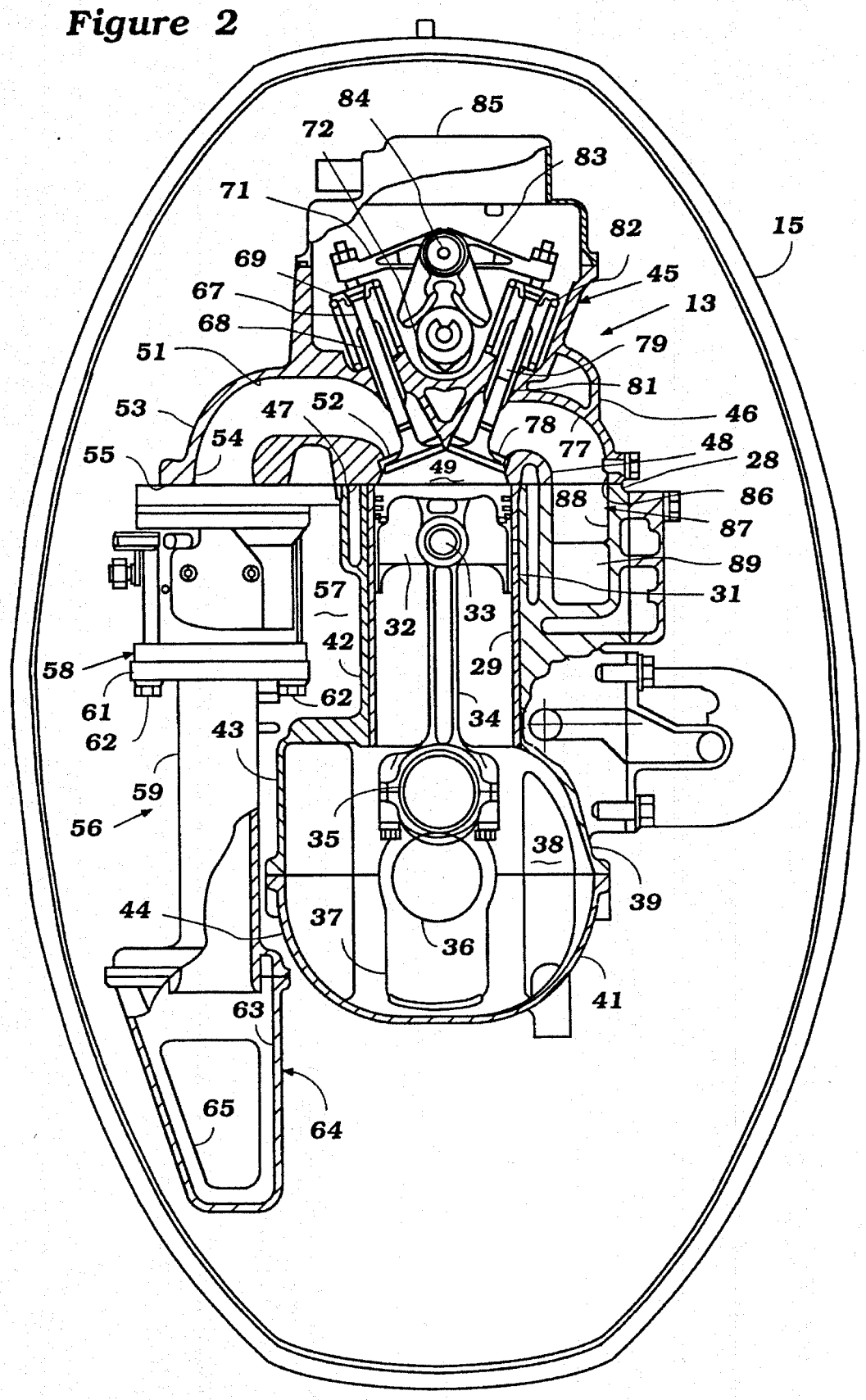
FIG. 2 is an enlarged top plan view of the outboard motor power head with the main protective cowling portion removed and portions of the engine broken away and shown in section.
Figure 3:
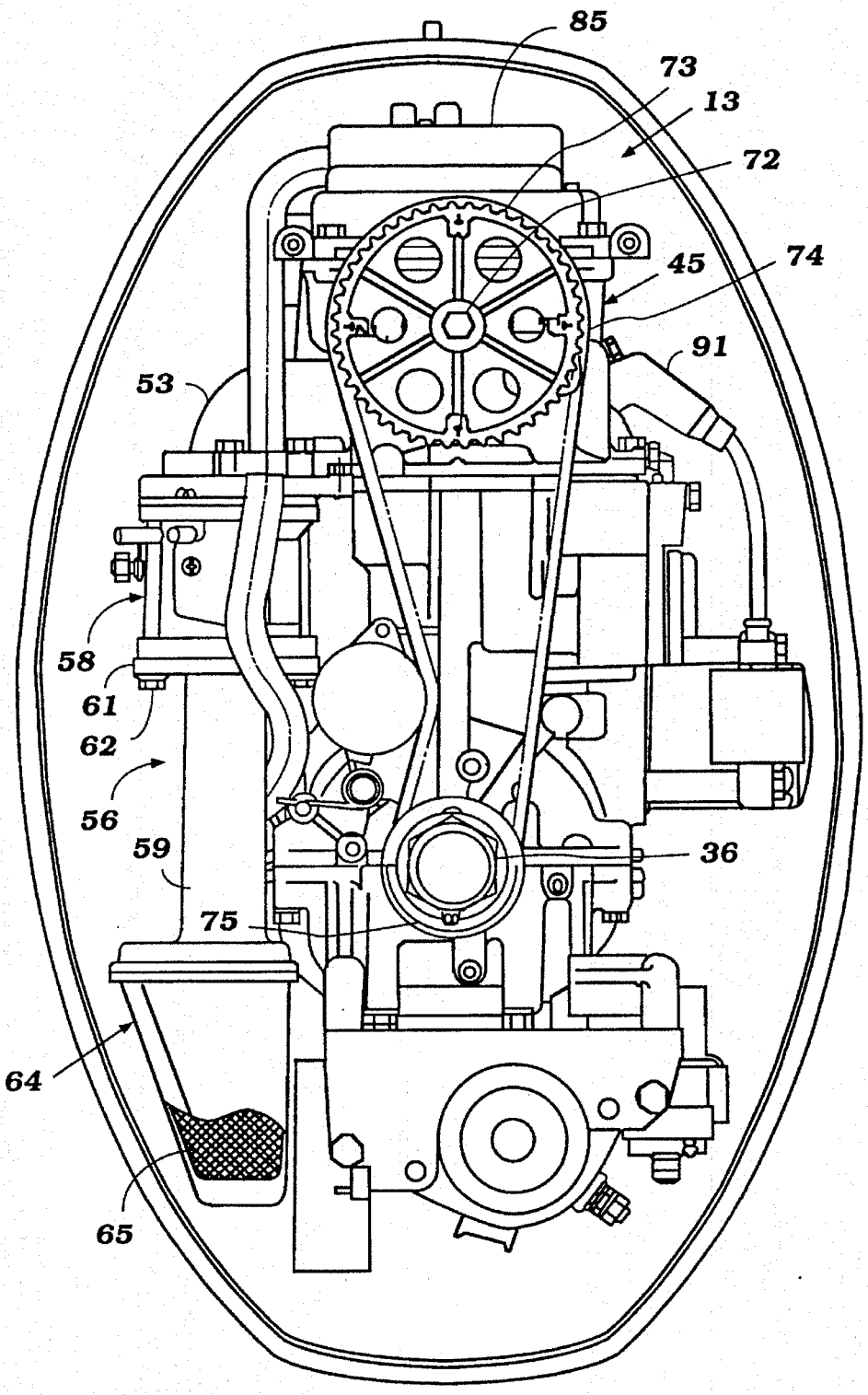
FIG. 3 is an enlarged top plan view of the power head with the main protective cowling member removed to more clearly show the top end face of the engine.
Figure 4:
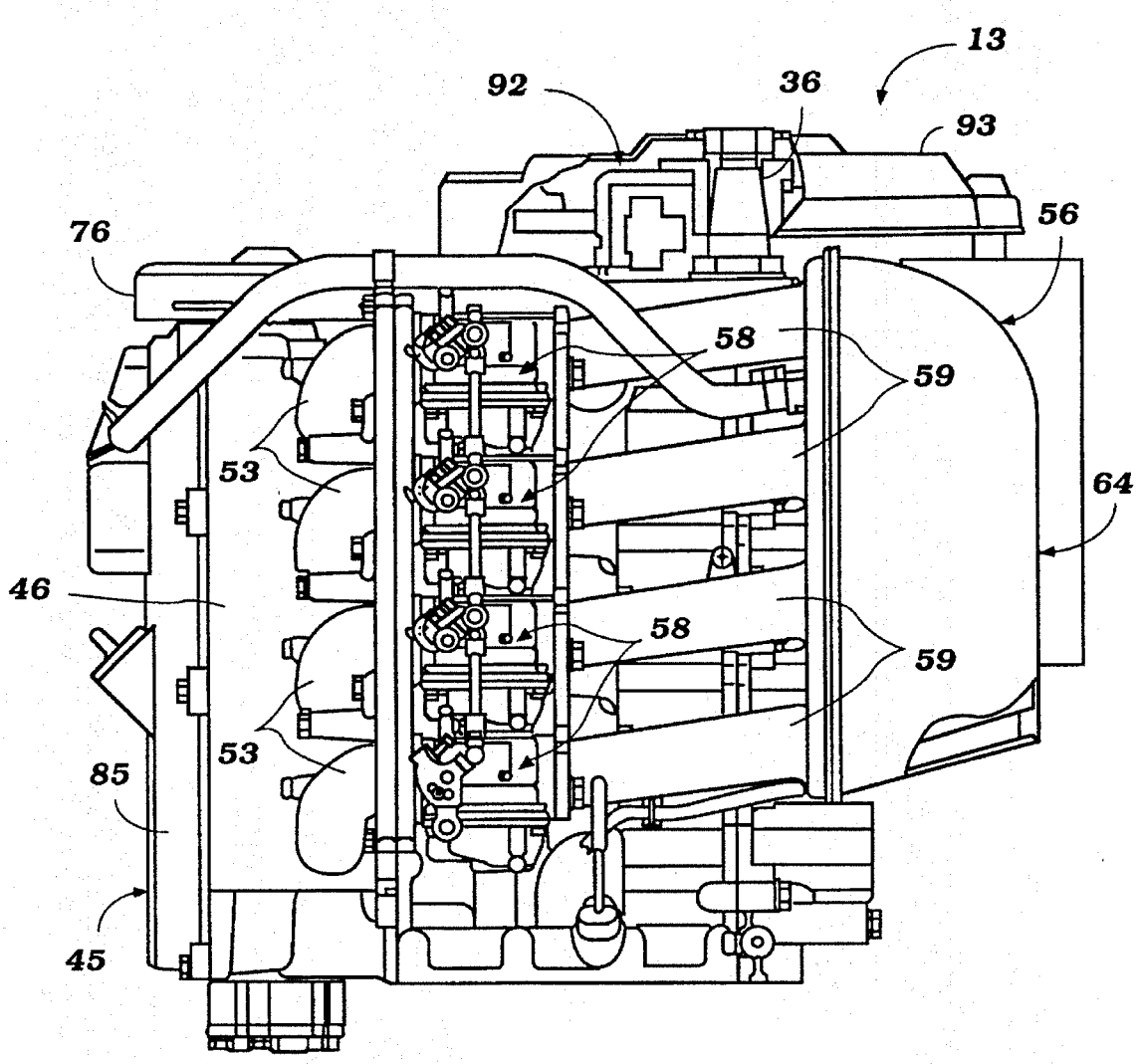
FIG. 4 is an enlarged side elevational view of the engine looking at the intake side.

An engine constructed in accordance with a first embodiment of the invention is illustrated in FIGS. 2–4 and will be now described by particular reference to those figures. The engine is identified by the same reference numeral 13 as applied in FIG. 1 inasmuch as FIG. 1 is a specific illustration of an embodiment incorporating this particular engine. As will become apparent, the invention can be practiced with other types of engines and another specific embodiment will be described later by reference to FIG. 5.

The engine 13 in this embodiment is of the 4-cylinder, 4-cycle in-line type. It will be apparent to those skilled in the art how the invention can be employed with engines having other numbers of cylinders and also how the invention can be utilized with engines having other cylinder formations such as a V-type engine, as shown specifically in FIG. 5.

The engine 13 includes a cylinder block 28 in which four vertically spaced, horizontally disposed cylinder bores 29 are formed by pressed or cast in liners 31. The cylinder block 28 may be formed from an aluminum or aluminum alloy while the liners 31 may be formed from a harder more wear resistant material. Pistons 32 reciprocate in the cylinder bores 29 and are connected by means of piston pins 33 to the upper or small end of a connecting rod 34. The lower end of the connecting rod 34 is split for connection to a throw 35 of a crankshaft 36. The crankshaft 36 is formed with counterweights 37 and is rotatably journalled within a crankcase chamber 38 formed by a skirt 39 of the cylinder block 28 and a crankcase member 41 that is detachably affixed to the cylinder block 28 in a well known manner.

It should be noted that the crankcase chamber 38 in effect bulges outwardly from the side walls of the cylinder block 29 and specifically a side wall 42 which is formed on the intake side of the engine, as will become apparent. Thus, the crankcase chamber 38 is defined by an outer peripheral portion on the side that is comprised of an upper part 43 formed by the cylinder block skirt 39 and a lower part 44 that is formed by the crankcase member 41. It will be readily apparent that the parts 43 and 44 extend a substantial distance outwardly from the cylinder block side wall 42. This forms a void area that is utilized in a purpose which will be described.

A cylinder head assembly, indicated generally by the reference numeral 45, is affixed to the cylinder block 28 on the side of the cylinder bores 29 opposite the crankcase chamber 38. This cylinder head assembly 45 includes a main cylinder head casting 46 that has a lower surface 47 that is held in sealing engagement with an upper surface 48 of the cylinder block 28 by means of a plurality of fasteners in a known manner. The cylinder head surface 47 is formed with a plurality of recesses 49 each of which cooperates with a respective one of the cylinder bores 29 and pistons 32 to form the combustion chambers of the engine.

Intake passages 51 extend from intake valve seats 52 formed in the cylinder head casting 46 in the recesses 49 outwardly toward the intake side of the engine. In accordance with an important feature of the invention, these intake passages 51 extend through outwardly extending portions 53 formed integrally with the cylinder head casting 46 on the intake side of the engine and terminate in inlet openings 54 formed in a lower surface 55 of the cylinder head casting 46 which surface is coplanar with the surface 47 in the illustrated embodiment.

An induction and charge forming system, indicated at generally by the reference numeral 56 is positioned on the intake side of the engine 13 and in part extending into a recessed area 57 formed by the inward placement of a cylinder block side surface 42 from the crankcase chamber side surfaces 43 and 44 for supplying a fuel air charge to the cylinder head intake passages 51. This induction system 56 includes a plurality of charge formers, for (one per cylinder in the illustrated embodiment) which are indicated generally by the reference numeral 58 and which may be any conventional type of side draft carburetor. Side draft carburetors are preferred due to the horizontal disposition of the cylinder bores 29 and the cylinder head intake passages 51. It will be readily apparent to those skilled in the art, however, that other forms of charge forming systems may be employed. The invention does have particular utility in conjunction with carburetors such as the carburetor 58 because these instruments are generally rather bulky and can be still kept close to the cylinder block 28 and positioned within the recessed area 57 without requiring any enlargement of the protective cowling 14 and specifically the main cowling member 16. Although this member does not appear in FIGS. 2 and 3, its outline matches that of the tray 15 which does appear in these figures.

Since the exact form of the carburetor 58 or type of the charge former employed is not a part of the invention, further details of the charge former are not believed to be necessary to enable those skilled in the art to practice the invention.

A plurality of intake pipes, one for each charge former 58 form a further part of the induction system 56 and these intake pipes are indicated by the reference numeral 59. Each intake pipe 59 has a flange portion 61 that is connected by means of threaded fasteners 62 to the inlet of the respective carburetor 58. The intake pipes 59 extend along the side of the engine in close proximity to the crankcase chamber 38 and specifically its side surfaces 43 and 44 so as to again maintain a compact construction. As may be seen in FIG. 4, the intake pipes 59 may slant slightly vertically upwardly.

The inlet ends of the intake pipes 59 extend into a volume 63 of a plenum chamber air inlet device, indicated generally by the reference numeral 64. The volume of the plenum chamber 63 and the length of the intake pipes 59 is tuned so as to provide optimum induction efficiency for a particular engine running condition. In the illustrated embodiment, this particular engine running condition is the mid or high mid range running of the engine and this efficiency is accommodated by the ability to make the intake pipes 59 relatively long. In addition, this length permits the air inlet device 64 to be disposed substantially beyond the crankcase chamber 38 on the side opposite the cylinder bores 29. In fact, an intake device 64 extends beyond the lower crankcase member 41 but still does not require any enlargement of the protective cowling 14 including the main cowling member 16 as should be readily apparent.

An air inlet opening 65 is formed in the inlet device 64 and a coarse filter screen may be positioned across it to prevent large foreign objects from being inducted. The main cowling member 16 of the protective cowling 14 is provided with a suitable atmospheric air inlet opening of any known type so as to permit adequate air to be drawn into the protective cowling from the atmosphere for induction into the engine 13.

It has been noted that the cylinder head intake passages 51 extend from intake valve seats 52. Poppet-type intake valves 67 are slidably supported within valve guides 68 in the cylinder head casting 46 and cooperate with the valve seats 52 for controlling the flow of the intake charge into the combustion chambers 49. Coil compression springs 69 normally urge the intake valve 67 to their closed positions. The intake valves 67 are opened by means of intake rocker arms 71 which cooperate with the intake cam lobes of a camshaft 72 that is journalled in the cylinder head casting 46 in a known manner.

A timing sprocket 73 (FIG. 3) is affixed to the upper end of the camshaft 72 and is driven by a flexible transmitter such as a toothed belt 74. The toothed belt 74 cooperates with a driving sprocket 75 that is affixed to the crankshaft 36 at a point just slightly above the upper end of the cylinder block 28 and cylinder head casting 46. The diameter of the sprockets 75 and 73 is such that the camshaft 72 will rotate at one half of the rotational speed of the crankshaft 36 for a well known reason. The cam driving mechanism including the toothed belt 74 is enclosed by means of a protective cover 76 (FIG. 4) that is affixed to the cylinder head assembly 45 and cylinder block casting 28 in any known manner.

Exhaust passages 77 are formed in the cylinder head casting 46 on the side opposite the intake passages 51. These exhaust passages 77 extend from exhaust valve seats 78 fixed in the cylinder head casting 46 in each of the combustion chamber recesses 49. Exhaust valves 79 are slidably supported within exhaust valve guides 81 fixed in the cylinder head casting 46 and cooperate with the exhaust valve seats 78 for communicating the combustion chamber 49 with the exhaust passages 47. The exhaust valves 79 are urged to their closed position by coil compression springs 82 in a known manner. Exhaust rocker arms 83 cooperate with exhaust cam lobes of the camshaft 72 for opening the exhaust valve 79 in a well known manner.

The intake rocker arm 71 and exhaust rocker arms 83 are pivotably supported on a rocker arm shaft 84 that is journalled or fixed to the cylinder casting 46 in any known manner. The valve mechanism as thus far described is covered by means of a cam cover 85 that is detachably connected to the cylinder head casting 46 in a known manner and which completes the cylinder head assembly 45.

The exhaust passages 77 like the intake passages 56 have a generally inverted "U" shape and terminate in a downwardly facing exhaust outlet openings 86 that cooperate with an exhaust manifold, indicated generally by the reference numeral 87 and formed integrally within the cylinder block casting 28 in a manner as described in my copending application entitled "Internal Combustion Engine", Ser. No. 08/221,871 filed Apr. 1, 1994 and assigned to the assignee hereof. Reference may be had to that application, the disclosure of which is incorporated herein by reference, for the details of the actual construction of the exhaust manifold. Briefly summarized, however, the exhaust manifold comprises a plurality of runners 88 that extend from the upper surface 48 of the cylinder block 28 and which terminate in a collector section 89 formed integrally in the cylinder block 28. This collector section has a downwardly facing discharge opening which communicates with an exhaust system of a known type contained within the drive shaft housing 18.

Spark plugs 91 are mounted in the cylinder head casting 46 and have their spark gaps extending into the combustion chamber recesses 49 for firing the charge therein. These spark plugs are fired in a known manner by an ignition system which includes a flywheel magneto assembly, indicated generally by the reference numeral 92 (FIG. 4) which is affixed to the upper end of the crankshaft 36 above the timing belt 74. This flywheel magneto 92 is enclosed by a protective cover 93 that is affixed to the cylinder block 28 and crankcase member 41 in a known manner.

Since the invention deals primarily with the induction system 56, other details of the engine 13 such as its lubrication system and so forth may be considered to be conventional inasmuch as any type of conventional components may be utilized with the induction system and cylinder head arrangement as described.

Figure 5:
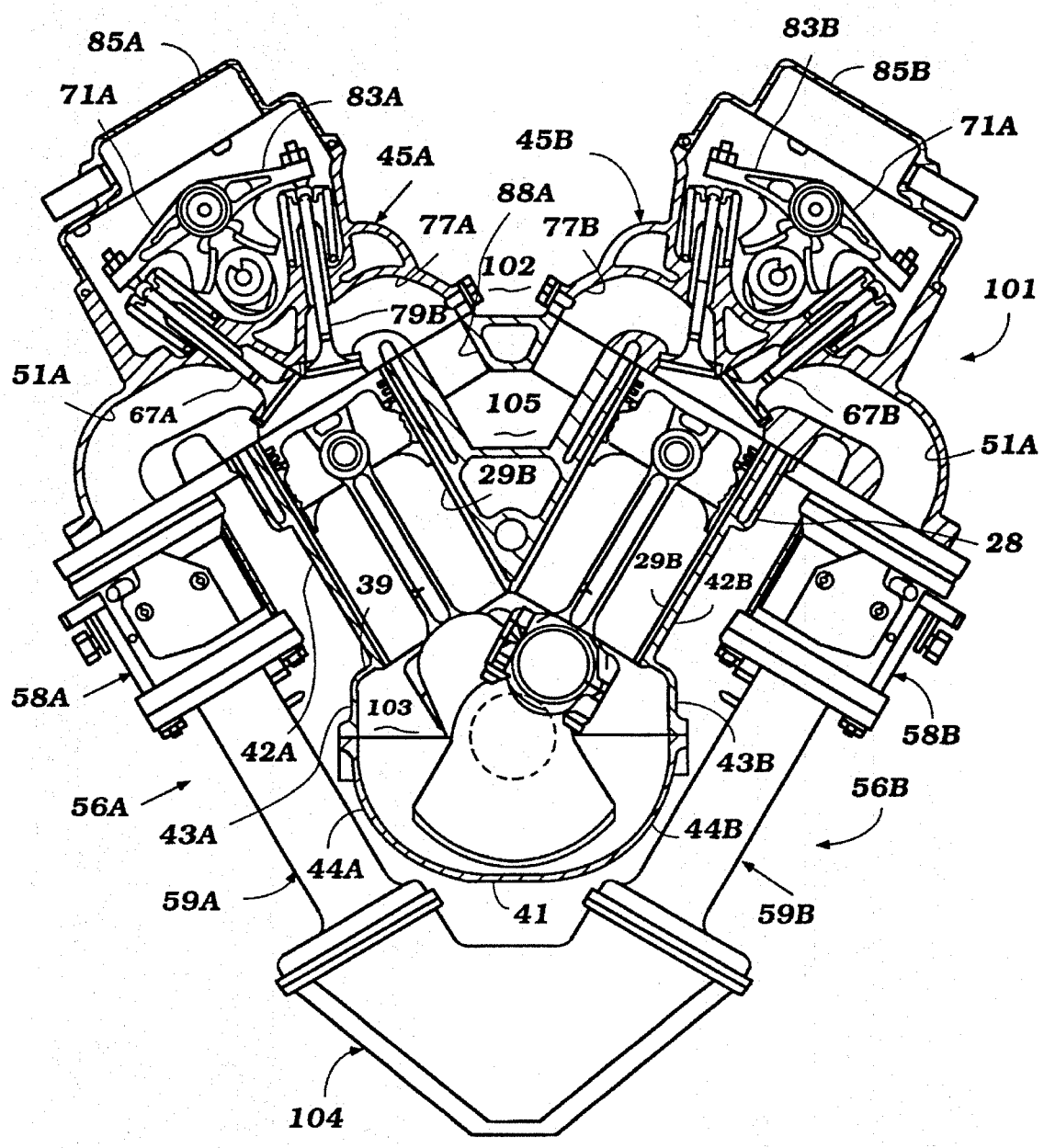
FIG. 5 is a partial top plan view, in part similar to FIG. 2, showing application of the invention to a V-type engine and with the entire protective cowling removed and portions of the engine broken away and shown in section.

As has been previously noted, the invention is not limited to application to in-line type engines and FIG. 5 shows the application of the invention to a V-type engine. Since the basic components of the engine are the same, components that are the same or substantially the same have been identified by the same reference numerals.

The V-type engine embodying the invention is identified generally by the reference numeral 101 and it differs from the engine 13 in that its cylinder block has a pair of angularly disposed cylinder banks. These cylinder banks each have respective cylinder bores 29 and components as shown in the previously described embodiment and those associated with each of the cylinder banks are designated by the suffixes A and B with the reference numerals from the embodiment of FIGS. 2–4 where the parts are the same or substantially the same. For this reason, it is not believed to be necessary to describe the internal components of the engine 101 in that the foregoing description will be adequate.

Each bank containing the cylinder bores 29A and 29B has a respective outer surface 42A and B that is disposed on the outside of the engine from the valley 102 that is formed between the cylinder banks and the respective cylinder head assemblies 45A and 45B. Thus, each cylinder bank has its respective cylinder head intake passage 51A and 51B disposed on the outside of the engine outwardly of the valley 102. Thus, induction systems 56A and 56B which have the construction as previously described may be employed. It should be noted that because of the "V" configuration, the crankcase chamber, indicated generally by the reference numeral 103 has a slightly different configuration so as to accommodate the angularly disposed cylinder bores 29A and 29B. However, the cylinder block skirt 39 has outer surfaces 43A and 43B on both sides of the engine and the crankcase member 41 also has outside surfaces 44A and 44B as with the previous embodiment.

In this embodiment, however, the intake pipes 59A and 59B extend to a common plenum chamber, air inlet device, indicated generally by the reference numeral 104 which is disposed forwardly of the crankcase member 41 and still within an area of the protective cowling which is generally open. This configuration also permits a very compact protective cowling and yet an induction system which can be tuned for optimum performance at mid or high mid range running. Although the embodiment in FIG. 5 shows a common plenum chamber air inlet device 104 for both cylinder banks, it should be readily apparent to those skilled in the art that separate plenum chamber air inlet devices may be supplied for each of the induction systems 56A and 56B.

In this embodiment of the invention, the exhaust passages 77A and 77B of the respective cylinder head assemblies 45A and 45B extend into the valley 102 between the cylinder banks. Hence, it is possible to use a common exhaust manifold collector, indicated by the reference numeral 105, for collecting the exhaust gases from the cylinder head exhaust passage 77A and 77B through respective runner sections 88A and 88B formed integrally within the cylinder block casting 28 between the cylinder bores 29A and 29B and in the valley 102. Except for the points noted, it is believed that the construction and operation of this embodiment will be readily apparent to those skilled in the art from the foregoing description of the embodiment of FIGS. 1–4.

It should be readily apparent from the foregoing description that the described embodiments of the invention provide a very effective cylinder head and intake system for an internal combustion engine which promotes a very compact construction and one which lends itself for application in environments where such compact construction such as an outboard motor is required. Of course, the foregoing description is that of preferred embodiments of the invention and various changes and modifications may be made without departing from the spirit and scope of the invention, as defined by the appended claims.

I claim:

1. An internal combustion engine comprised of a cylinder block defining at least one cylinder bore, a cylinder head affixed to said cylinder block at one end thereof enclosing one end of said cylinder bore, said cylinder head having an intake port on one side of an axial plane containing the axis of said cylinder bore and serving said cylinder bore, a crankcase chamber formed at the other end of said cylinder block and containing a crankshaft journalled for rotation about an axis at the other end of said cylinder bore and driven by a piston reciprocating in said cylinder bore, said cylinder block having a first portion on said one side of said axial plane juxtaposed to said cylinder bore and terminating at a second portion extending laterally outwardly from said axial plane beyond said first portion and defining in part said crankcase chamber for clearing the rotation of said crankshaft, a charge forming device serving said intake port and juxtaposed to said first portion of said cylinder block, an air intake pipe extending from said charge forming device along at least a portion of said crankcase chamber, and a plenum chamber communicating with said intake pipe and positioned at least in part beyond the termination of said crankcase chamber in the direction of said axial plane on the side opposite said cylinder bore.

2. The internal combustion engine of claim 1 wherein the charge forming device comprises a carburetor.

3. The internal combustion engine of claim 2 wherein the plenum chamber provides a silencing function for the intake air.

4. The internal combustion engine of claim 3 wherein the volume of the plenum chamber and the length of the intake pipe is tuned for providing an optimum performance at a certain engine running condition.

5. The internal combustion engine of claim 4 wherein the certain running condition comprises a mid-range running condition.

6. The internal combustion engine of claim 5 wherein the engine forms a power unit for the power head of an outboard motor, said power head further including a protective cowling encircling said engine, said engine being disposed so that the crankshaft axis is vertically disposed, a drive shaft housing and lower unit depending from said power head and containing a propulsion device driven by said crankshaft for powering an associated watercraft.

7. The internal combustion engine of claim 1 wherein the cylinder head intake port serves an intake passage extending from the combustion chamber and terminating in a surface of the cylinder head extending substantially coplanar with the surface thereof engaged with the cylinder block and at the one side of the engine.

8. The internal combustion engine of claim 7 wherein the charge forming device comprises a carburetor.

9. The internal combustion engine of claim 8 wherein the plenum chamber provides a silencing function for the intake air.

10. The internal combustion engine of claim 9 wherein the volume of the plenum chamber and the length of the intake pipe is tuned for providing an optimum performance at a certain engine running condition.

11. The internal combustion engine of claim 10 wherein the certain running condition comprises a mid-range running condition.

12. The internal combustion engine of claim 8 wherein the engine forms a power unit for the power head of an outboard motor, said power head further including a protective cowling encircling said engine, said engine being disposed so that the crankshaft axis is vertically disposed, a drive shaft housing and lower unit depending from said power head and containing a propulsion device driven by said crankshaft for powering an associated watercraft.

13. The internal combustion engine of claim 1 wherein the cylinder block is comprised of a pair of cylinder banks each defining at least one cylinder bore and a cylinder head is affixed to each of the cylinder banks and with the cylinder banks and forming a valley therebetween, the cylinder head intake ports extending on the side of the engine disposed transversely outwardly from the valley and a charge forming device, intake pipe and plenum chamber serving each of the cylinder head intake passages.

14. The internal combustion engine of claim 13 wherein a common plenum chamber serves the intake pipes of both of the cylinder banks.

15. The internal combustion engine of claim 13 wherein the cylinder head intake ports serve intake passages extending from the combustion chamber and terminating at the one side of the engine in a surface of the cylinder head extending substantially coplanar with the cylinder head surface engaged with the cylinder block.

16. The internal combustion engine of claim 15 wherein the charge forming devices comprise carburetors.

17. The internal combustion engine of claim 16 wherein the plenum chamber provides a silencing function for the intake air.

18. The internal combustion engine of claim 17 wherein the volume of the plenum chamber and the length of the intake pipes are tuned for providing an optimum performance at a certain engine running condition.

19. The internal combustion engine of claim 18 wherein the certain running condition comprises a mid-range running condition.

20. The internal combustion engine of claim 13 wherein the engine forms a power unit for the power head of an outboard motor, said power head further including a protective cowling encircling said engine, said engine being disposed so that the crankshaft axis is vertically disposed, a drive shaft housing and lower unit depending from said power head and containing a propulsion device driven by said crankshaft for powering an associated watercraft.

21. The internal combustion engine of claim 1 wherein there are a plurality of cylinder bores in the cylinder block in aligned relationship and the cylinder head has an intake port served by an induction system as described for each cylinder bore.

22. The internal combustion engine of claim 21 wherein the cylinder head intake ports serve intake passages extending from the combustion chamber and terminating in a surface of the cylinder head extending substantially coplanar with the cylinder head surface engaged with the cylinder block.

23. The internal combustion engine of claim 22 wherein the cylinder block is comprised of a pair of cylinder banks each defining a plurality of cylinder bores and a cylinder head affixed to each of the cylinder banks and with the cylinder banks and forming a valley therebetween, the cylinder head intake ports extending on the side of the engine disposed transversely outwardly from the valley and a charge forming device, intake pipe and plenum chamber serving each of the cylinder heads.

24. The internal combustion engine of claim 23 wherein a common plenum chamber serves the intake pipes of each of the cylinder banks.

25. The internal combustion engine of claim 24 wherein the engine forms a power unit for the power head of an outboard motor, said power head further including a protective cowling encircling said engine, said engine being disposed so that the crankshaft axis is vertically disposed, a drive shaft housing and lower unit depending from said power head and containing a propulsion device driven by said crankshaft for powering an associated watercraft.

26. The internal combustion engine of claim 21 wherein the engine forms a power unit for the power head of an outboard motor, said power head further including a protective cowling encircling said engine, said engine being disposed so that the crankshaft axis is vertically disposed, a drive shaft housing and lower unit depending from said power head and containing a propulsion device driven by said crankshaft for powering an associated watercraft.

27. An internal combustion engine comprised of a cylinder block defining at least one cylinder bore, a cylinder head having a sealing surface affixed to said cylinder block at one end thereof enclosing one end of said cylinder bore, said cylinder head having an intake port on one side thereof serving said cylinder bore, an intake passage extending from said intake port through said cylinder head and terminating in a surface that extends parallel to said sealing surface, an induction system having flange means directly affixed to said surface for supplying an intake charge to said intake passage, a crankcase chamber formed at the other end of said cylinder block and containing a crankshaft journalled for rotation about an axis at the other end of said cylinder bore and driven by a piston reciprocating in said cylinder bore.

28. The internal combustion engine of claim 27 wherein the cylinder block has a plurality of aligned cylinder bores and the cylinder head has an intake port, intake passage, and induction system associated with each of the cylinder bores.

29. The internal combustion engine of claim 28 wherein the cylinder block has a first portion on the side thereof adjacent the intake passage juxtaposed to the cylinder bores and terminating at a second portion extending laterally outwardly beyond said first portion and defining in part said crankcase chamber for clearing the rotation of said crankshaft, the induction system comprising charge forming means affixed to said cylinder head and supplying a charge to said intake passages, said charge forming means being juxtaposed to said cylinder block first portion.

30. The internal combustion engine of claim 29 wherein the induction system further comprises a plurality of intake pipes extending from said charge forming means away from said cylinder head surface and in proximity to said second portion of said engine.

31. The internal combustion engine of claim 30 further including a plenum chamber disposed on the side of said crankcase chamber opposite the cylinder bore side and serving the intake pipes.

32. The internal combustion engine of claim 31 wherein the plenum chamber is spaced beyond the end of the crankcase chamber.

33. The internal combustion engine of claim 29 wherein the cylinder block has a pair of cylinder banks each provided with a plurality of cylinder bores and served by a charge former.

34. The internal combustion engine of claim 33 wherein the induction system further comprises a plurality of intake pipes extending from said charge former away from said cylinder head surface and in proximity to said second portion of said engine.

35. The internal combustion engine of claim 34 further including a plenum chamber disposed on the side of said crankcase chamber opposite the cylinder bore side and serving the intake pipes.

36. The internal combustion engine of claim 35, wherein the intake pipes of the respective cylinder banks are served by a common plenum chamber.

* * * * *